US009352236B1

(12) United States Patent
Fernandez

(10) Patent No.: US 9,352,236 B1
(45) Date of Patent: May 31, 2016

(54) FLOATING ENTERTAINMENT AND COMMUNICATION SYSTEMS

(71) Applicant: Kari Fernandez, San Jose, CA (US)

(72) Inventor: Kari Fernandez, San Jose, CA (US)

( * ) Notice: Subject to any disclaimer, the term of this patent is extended or adjusted under 35 U.S.C. 154(b) by 0 days.

(21) Appl. No.: 14/880,218

(22) Filed: Oct. 10, 2015

Related U.S. Application Data

(60) Provisional application No. 62/067,946, filed on Oct. 23, 2014.

(51) Int. Cl.

| | |
|---|---|
| ***A63H 23/10*** | (2006.01) |
| ***A63G 31/00*** | (2006.01) |
| ***H04W 84/00*** | (2009.01) |
| *A01K 91/02* | (2006.01) |

(52) U.S. Cl.
CPC ..... *A63G 31/007* (2013.01); *H04W 84/005* (2013.01)

(58) Field of Classification Search
CPC ..... A63H 23/00; A63H 23/04; A63H 23/08; A63H 23/10; A63H 13/00; A63H 13/45; A01K 91/00; A01K 91/02
USPC ..... 446/71, 75, 76, 153, 160, 163, 164, 446/165; 441/1, 129; 43/26.1
See application file for complete search history.

(56) References Cited

U.S. PATENT DOCUMENTS

| | | | | |
|---|---|---|---|---|
| 4,503,563 | A * | 3/1985 | Johnson | F21S 9/02 362/158 |
| 5,369,796 | A | 11/1994 | Kung | |
| 5,581,932 | A * | 12/1996 | Bell | A01K 91/02 43/26.1 |
| 6,793,552 | B2 * | 9/2004 | Derrah | A63H 13/045 446/154 |
| 7,247,069 | B2 | 7/2007 | Porat | |
| 2010/0310194 | A1 | 12/2010 | Archambault | |

* cited by examiner

*Primary Examiner* — Kien Nguyen
(74) *Attorney, Agent, or Firm* — RG Patent Consulting, LLC; Rachel Gilboy

(57) ABSTRACT

A floating entertainment and communication system is a floating multipurpose apparatus for use in conjunction with personal electronic devices while floating on a body of water. The system is designed to amplify audio from various audio sources such as personal music players and display video from video players that are able to be docked in one of the waterproof docking stations in the center column. The system has capabilities to have 2-way communication with a remote transreceiver for convenience and for rapid response in water related emergencies.

20 Claims, 5 Drawing Sheets

FLOATING ENTERTAINMENT AND COMMUNICATION SYSTEMS

CROSS-REFERENCE TO RELATED APPLICATION

The present application is related to and claims priority from prior provisional application Ser. No. 62/067,946, filed Oct. 23, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of floating electronic swimming pool accessories and more specifically relates to a floating entertainment and communication system.

2. DESCRIPTION OF THE RELATED ART

Swimming is a very popular warm weather activity that is enjoyed by millions. The activity can be enjoyed in a swimming pool, lake, river, or other types of waterways. Very often, picnics or social gatherings are centered on swimming. Food, drinks, and music commonly characterize swimming activities and nearly always, the electronic devices such as music players and cell phones are kept away from the water since moisture and electronics are non-compatible. An individual that is swimming must leave the water and dry off, at least to some extent, in order to change the music, adjust the volume, or answer a cell phone. These items are generally left on a table above the ground surface and away from the water since water often gets splashed out of the pool, lake, or pond and can reach several feet away from the static water level. Even the smallest amount of water being splashed on or inside of cell phones or various other types of music players can spell doom for the device. Placing these items on top of most floatation devices is dangerous because the waves of the water can upset the floatation device dumping the electronic device into the water where they can never be salvaged. A solution for people that would like their electronic devices handy and on the water with them is needed.

Various attempts have been made to solve the above-mentioned problems such as those found in U.S. Pat. No. 7,247,069 to Joseph Porat, U.S. Publication No. 2010/0310194 to Roy Archambault, and U.S. Pat. No. 5,369,796 to Gregory E. Kung. This art is representative of floating electronic swimming pool accessories. None of the above inventions and patents, taken either singly or in combination, is seen to describe the invention as claimed.

Ideally, a floating electronic swimming pool accessory should provide multimedia entertainment with a 2-way wireless communication device, and yet, would operate reliably and be manufactured at a modest expense. Thus, a need exists for a reliable floating entertainment and communication system to avoid the above-mentioned problems.

BRIEF SUMMARY OF THE INVENTION

In view of the foregoing disadvantages inherent in the known floating electronic swimming pool accessory art, the present invention provides a novel floating entertainment and communication system. The general purpose of the present invention, which will be described subsequently in greater detail, is to provide multimedia entertainment and 2-way wireless communication with a remote transreceiver for convenience, safety, and rapid response to water related emergencies.

The floating entertainment and communication system is a floating multipurpose apparatus for use in conjunction with personal electronic devices that preferably comprises an upper portion that includes a center structure having a first side and a second side, a left cover and a right cover that is hingedly attached to the top edge of the first side and the second side respectively of a center structure, a liquid crystal display screen and at least one speaker mounted in the first side of the center structure, at least one waterproof docking station adapted for use with a plurality of digital electronic devices that may be in communication with the liquid crystal display screen and the speakers, and at least one electronic device charging station.

The bottom portion is a floating base that includes a bottom side, a top side, and a base perimeter. The upper portion is non-removably attached to the top side of the floating base which is adapted to float on a body of water while supporting the upper portion above the water level. The floating entertainment and communication system is useful as a floating device that is designed to work in conjunction with other digital electronic devices such as MP3 players, video players, and a 2-way radio communication system. The digital electronic devices are able to be docked within the waterproof docking stations and have the audio amplified through the speakers that are arranged adjacent to the liquid crystal display screen for entertainment or for safety purposes while the user is swimming. The floating entertainment and communication system preferably has a 2-way wireless communications system between the floating base and a remote transmitter/receiver.

The left cover and the right cover each may include a solar panel for powering the liquid crystal display screen, the speakers, the electronic device charging stations as well as any other accessories that may be included, and for recharging the rechargeable battery(s). The left cover and the right cover each include a means to be locked in an upwardly rotated position when in an in-use condition for viewing the LCD screen, hearing the speakers, and charging the batteries. The means to lock the left and right covers in the upward position may include a ball detent that will yield to a downward force on either cover, either by accident or by intentionally applying downward force to close the covers. In the upward position, the solar panels are angled for maximum exposure to the sun for charging the battery(s). The left cover and the right cover are also designed to provide a watertight seal around the center structure when the left and right covers are in a closed position. The left cover and the right cover each have a concaved formation designed to envelope and seal the center structure from moisture. The two covers come together and contact each other around the outside edges and around the bottom of the top side around the base where the top portion is joined to the base, using water tight seals. The center structure and the floating base are adapted to be water resistant themselves but have added protection when the left and right covers are in the closed position. The seal surface on each cover perimeter edge is able to resist water and protect any electronic devices that may be docked in the docking stations or any cell phones that might be placed within the receptacles. Cell phones placed within the receptacles are readily available so that the cell phone owner is close enough to hear a ring when a call comes in and does not have to leave the water to answer it.

The floating entertainment and communication system is substantially constructed of buoyant foam having a hardened plastic shell exterior. The center of gravity is centrally located and low enough so that the device is able to maintain stability while floating on the water and resists capsizing when the water becomes choppy. The center structure with the left cover and the right cover, in a closed position, measures approximately 10 inches in height, approximately 10 inches in width, and approximately 3 to 4 inches in thickness. The floating base is sized to provide the stability needed for each particular embodiment since the weight of the top portion may vary from embodiment to embodiment. Each embodiment may also vary in dimensions and is sized optimally for the particular accessories contained within each embodiment.

The floating entertainment and communication system further may include a long life, deep cycle, rechargeable battery. The rechargeable battery is in communication with the solar panels and able to receive a power recharge when solar rays are present. The waterproof docking station(s) and the electronic device charging station(s) are adapted to seal and protect a digital electronic device that may be docked therein. In addition to the above mentioned accessories, the floating entertainment and communication system may further include an exteriorly located red light capable of flashing when a signal from a wireless transmitter in a paired wristband is received. The sensor wristband is adapted to transmit a wireless signal to the wireless receiver in the base unit when a low oxygen level of the wearer is detected. The system may also include an audio response that may be transmitted to the remote receiver to warn of a possible emergency such as when the wristband wearer is not breathing or receiving enough air as occurs during drowning. The system serves as an early warning system to prevent deaths from drowning.

The floating base may be adapted to include wirelessly controlled propulsion and steering system that is manipulated via a servo-controlled rudder and motor driven propeller via the remote control unit. The remote control unit is adapted to manipulate the functions of a docked audio/video player and the volume of the onboard speakers in the center structure. The remote control unit for the propulsion and steering systems may be the same remote control unit that controls the audio, video, and volume of the onboard LCD screen and speakers by entering a separate mode and then using the up, down, left, and right arrows on the remote control unit. The floating entertainment and communication system preferably is also adapted to include wireless 2-way radio communication with a remote transreceiver for either entertainment purposes or for emergency purposes.

In some embodiments, the floating base may include a waterproof camera adapted for use underwater that is mounted to the bottom side of the floating base. The video signal from the waterproof camera is able to be transmitted to a remote viewing device, which may be the same transreceiver for the 2-way radio. A user remotely viewing the video transmissions may be able to monitor the safety of children or adults that are in the water. The rechargeable battery is sized to power the propulsion system as well as the underwater camera and any other onboard accessories.

The floating entertainment and communication system may be offered as a kit that includes a floating entertainment and communication system having an assembled upper portion and a floating base, at least one remote control unit, at least one audio/video player, at least one 2-way radio system having a remote transreceiver and a base transreceiver, at least one underwater camera system for mounting to the bottom side of the floating base, at least one rechargeable battery, and at least one set of user instructions.

The present invention holds significant improvements and serves as a floating entertainment and communication system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, floating entertainment and communication systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a floating electronic swimming pool accessory, and more particularly, to a floating entertainment and communication system as used to improve the convenience of multimedia entertainment and rapid response to water related emergencies.

Figure 1:
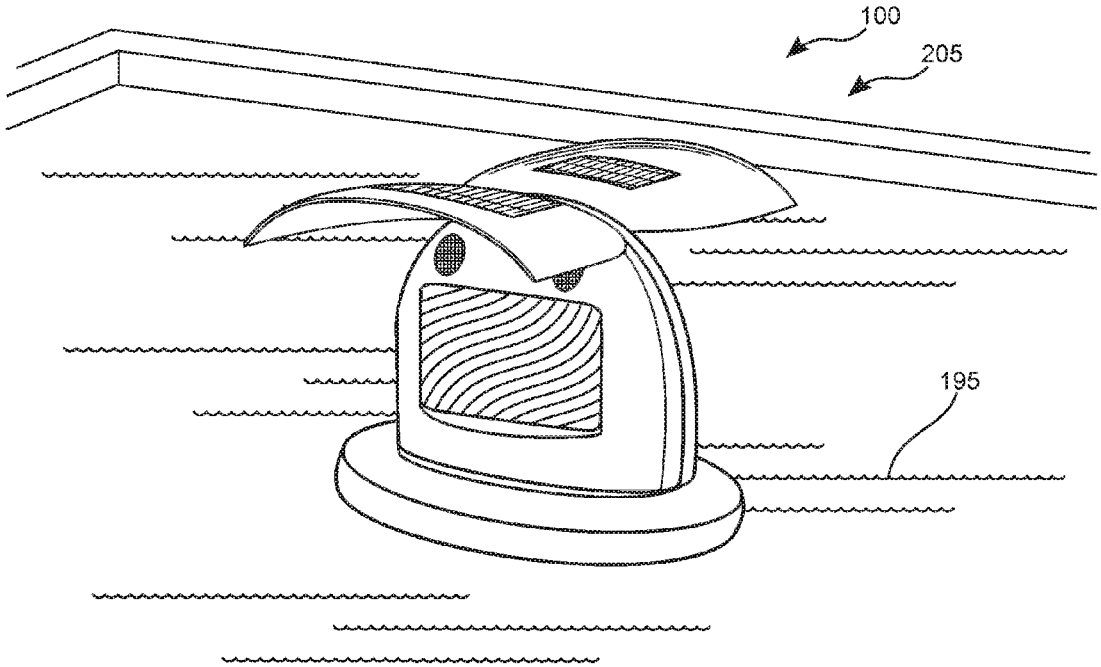
FIG. 1 shows a perspective view illustrating an in-use condition of a floating entertainment and communication system according to an embodiment of the present invention.

Referring to the drawings by numerals of reference there is shown in FIG. 1, a perspective view illustrating in-use condition 205 of floating entertainment and communication system 100 according to an embodiment of the present invention.

Floating entertainment and communication system 100 is a floating multipurpose apparatus for use in conjunction with personal electronic devices while floating on body of water 195. The system 100 is designed to amplify audio and play video from various audio sources such as audio/video player 185 that is able to be docked in one of waterproof docking station 150 in center structure 110. The system 100 has capabilities to have 2-way radio 275 communication with a remote transreceiver 265 for convenience and for rapid response in water related emergencies.

Figure 2:
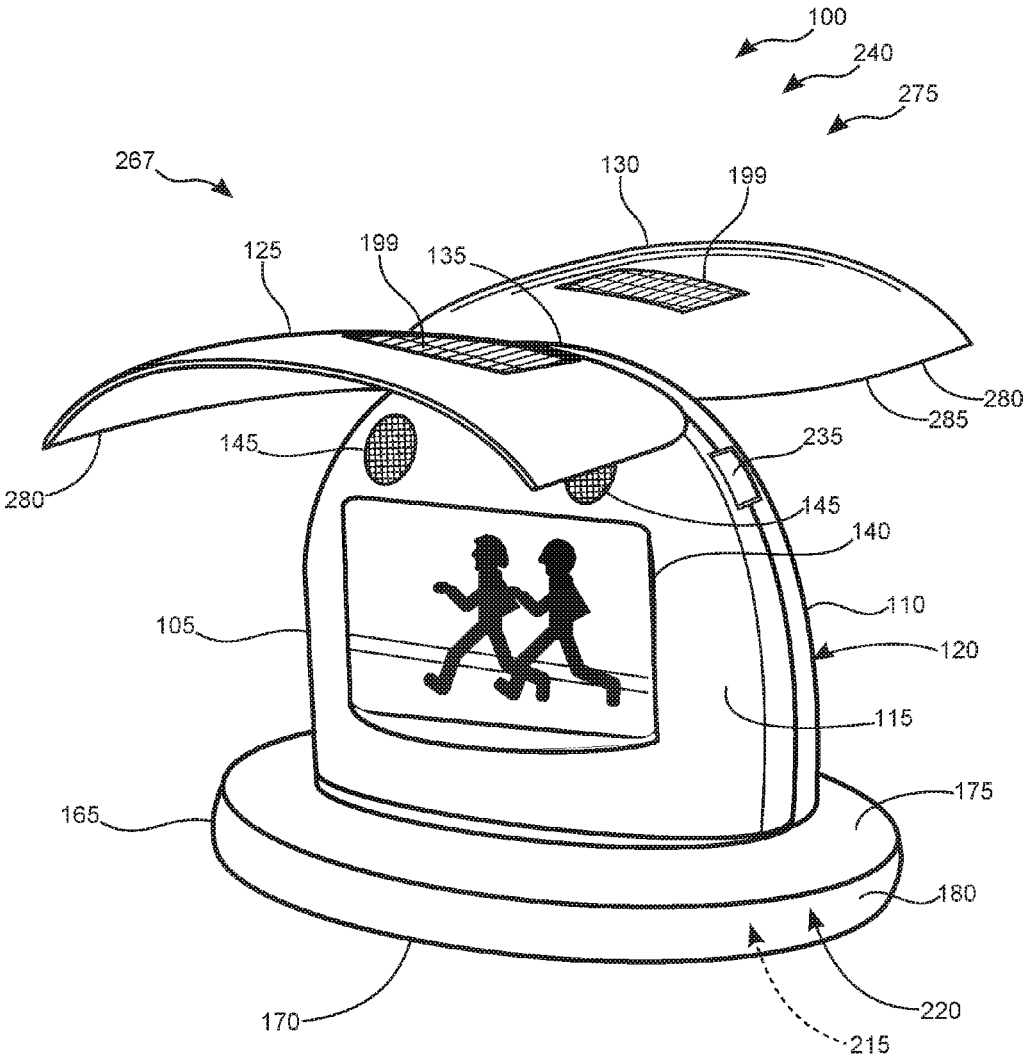
FIG. 2 is a perspective view illustrating the floating entertainment and communication system in an open position according to an embodiment of the present invention of FIG. 1.

Referring now to FIG. 2, a perspective view illustrating floating entertainment and communication system 100 in in-use condition 205 according to an embodiment of the present invention of FIG. 1.

Floating entertainment and communication system 100 is a floating multipurpose apparatus for use in conjunction with personal electronic devices that preferably comprises upper portion 105 that includes center structure 110 having first side 115 and second side 120, left cover 125 and right cover 130 that is hingedly attached to top edge 135 of first side 115 and second side 120 respectively of center structure 110, liquid crystal display screen 140 and at least one speaker 145 mounted in first side 115 of center structure 110, at least one waterproof docking station 150 adapted for use with a plurality of digital electronic devices 155 that may be in communication with liquid crystal display screen 140 and speaker 145, and at least one electronic device charging station 160.

Figure 3:
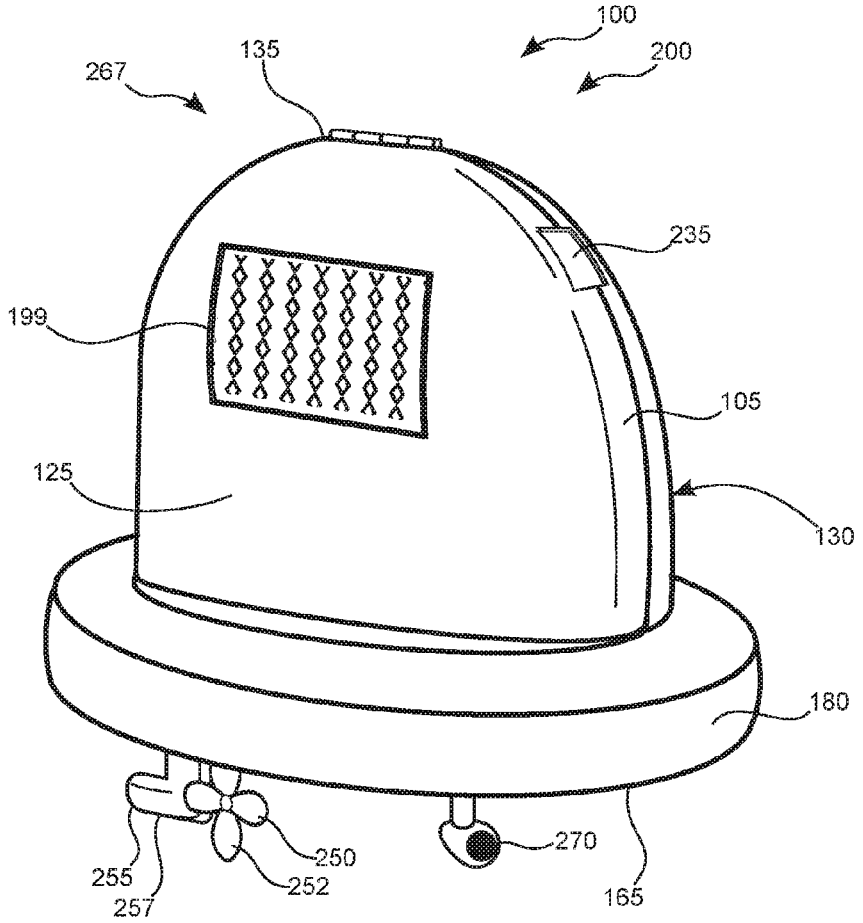
FIG. 3 is a perspective view illustrating the floating entertainment and communication system in a closed position according to an embodiment of the present invention of FIG. 1.

Referring now to FIG. 3, a perspective view illustrating floating entertainment and communication system 100 in closed position 200 according to an embodiment of the present invention of FIG. 1.

The bottom portion is floating base 165 that includes bottom side 170, top side 175, and base perimeter 180. Upper portion 105 is non-removably attached to top side 175 of floating base 165 which is adapted to float on body of water 195 while supporting upper portion 105 above water level. Floating entertainment and communication system 100 is useful as a floating device that is designed to work in conjunction with other digital electronic devices 155 such as MP3 players, video players, and a 2-way radio 275 communication system. Digital electronic devices 155 are able to be docked within waterproof docking stations 150 and have audio amplified through speaker(s) 145 that are arranged adjacent to liquid crystal display screen 140 for entertainment or for safety purposes while the user is swimming. Floating entertainment and communication system 100 preferably has 2-way radio 275 system between floating base 165 and remote transmitter/receiver 190.

Floating entertainment and communication system 100 is substantially constructed of buoyant foam 215 having hardened plastic shell 220 exterior. The center of gravity is centrally located and low enough so that the device is able to maintain stability while floating on body of water 195 and resists capsizing when body of water 195 becomes choppy. Center structure 110 with left cover 125 and right cover 130, in closed position 200, measures approximately 10 inches in height, approximately 10 inches in width, and approximately 3 to 4 inches in thickness. Floating base 165 is sized to provide the stability needed for each particular embodiment since the weight of upper portion 105 may vary from embodiment to embodiment. Each embodiment may also vary in dimensions and is sized optimally for the particular accessories contained within each embodiment.

Floating base 165 may be adapted to include wirelessly controlled propulsion system 250 and steering system 255 that is manipulated via a servo-controlled rudder 257 and motor driven propeller 252 via remote control unit 260. Remote control unit 260 is adapted to manipulate the functions of a docked audio/video player 185 and the volume of onboard speaker(s) 145 in center structure 110. Remote control unit 260 for propulsion 250 and steering system 255 may be the same remote control unit 260 that controls the audio, video, and volume of onboard liquid crystal display screen 140 and speaker(s) 145 by entering a separate mode and then using the up, down, left, and right arrows on remote control unit 260. Floating entertainment and communication system 100 preferably is also adapted to include wireless 2-way radio 275 communication with a remote transreceiver 265 for either entertainment purposes or for emergency purposes.

Figure 4:
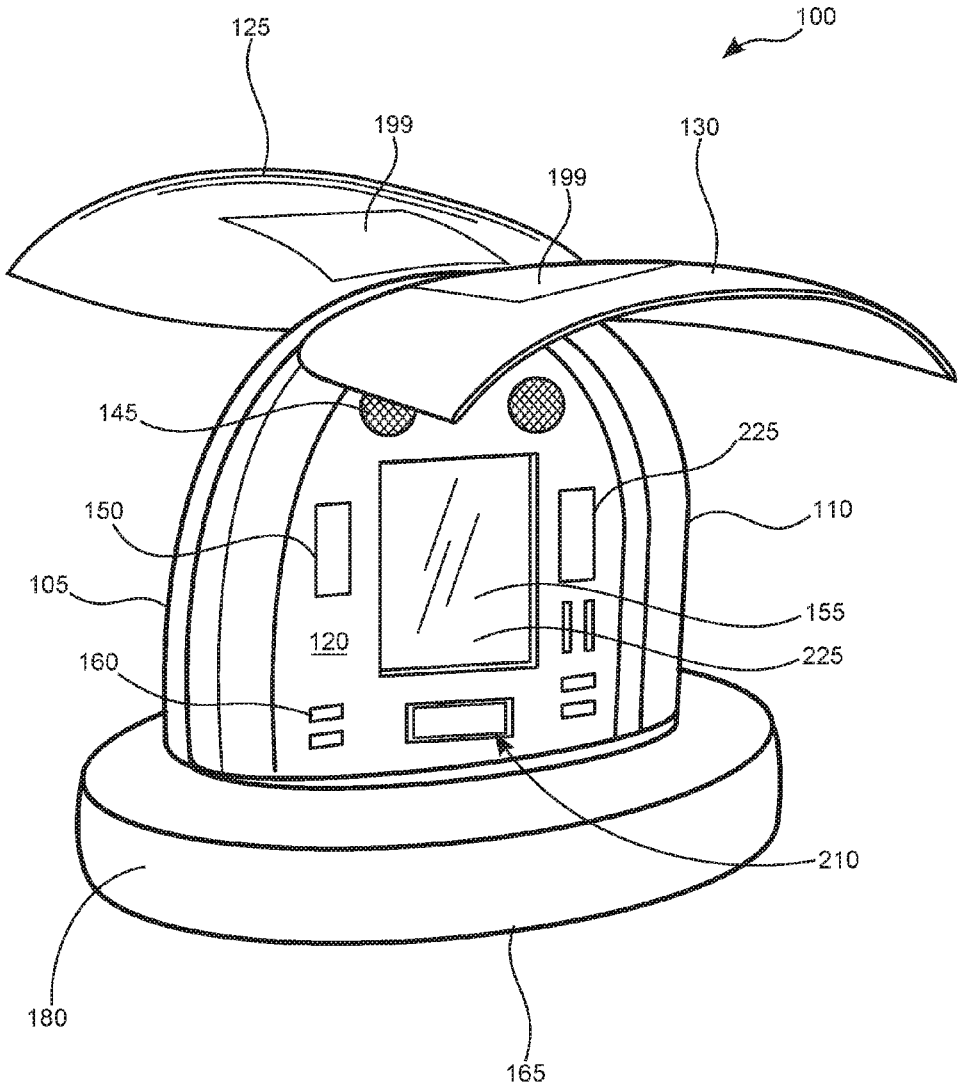
FIG. 4 is a perspective view illustrating the second side of the floating entertainment and communication system according to an embodiment of the present invention of FIG. 1.

Referring now to FIG. 4, showing a perspective view illustrating second side 120 of floating entertainment and communication system 100 according to an embodiment of the present invention of FIG. 1.

Left cover 125 and right cover 130 each may include solar panel 199 for powering liquid crystal display screen 140, speaker(s) 145, electronic device charging stations 160 as well as any other accessories that may be included, and for recharging rechargeable battery 210. Left cover 125 and right cover 130 each include a means to be locked in an upwardly rotated position when in in-use condition 205 for viewing liquid crystal display screen 140, hearing speaker(s) 145, and charging batteries 210. The means to lock left 125 and right cover 130 in the upward position may include a ball detent that will yield to a downward force on left 125 or right cover 130, either by accident or by intentionally applying downward force to close them. In in-use condition 205, solar panel(s) 199 are angled for maximum exposure to the sun for charging rechargeable battery(s) 210. Left cover 125 and right cover 130 are also designed to provide a watertight seal around center structure 110 when left 125 and right covers are in closed position 200. Left cover 125 and right cover 130 each have a concaved formation designed to envelope and seal center structure 110 from moisture. The two covers 125, 130 come together and contact each other around the outside edges and around the bottom of top side 175 around floating base 165 where upper portion 105 is joined to floating base 165, using water tight seals.

Center structure 110 and floating base 165 are adapted to be water resistant themselves but have added protection when left 125 and right cover 130 are in closed position 200. Seal surface 280 on each cover perimeter edge 285 is able to resist water and protect any electronic devices that may be docked in waterproof docking stations 150 or any cellular phones 230 that might be placed within receptacles 225. Cellular phone 230 placed within receptacles 225 are readily available so that cellular phone 230 owner is close enough to hear a ring when a call comes in and does not have to leave water to answer it.

Figure 5:
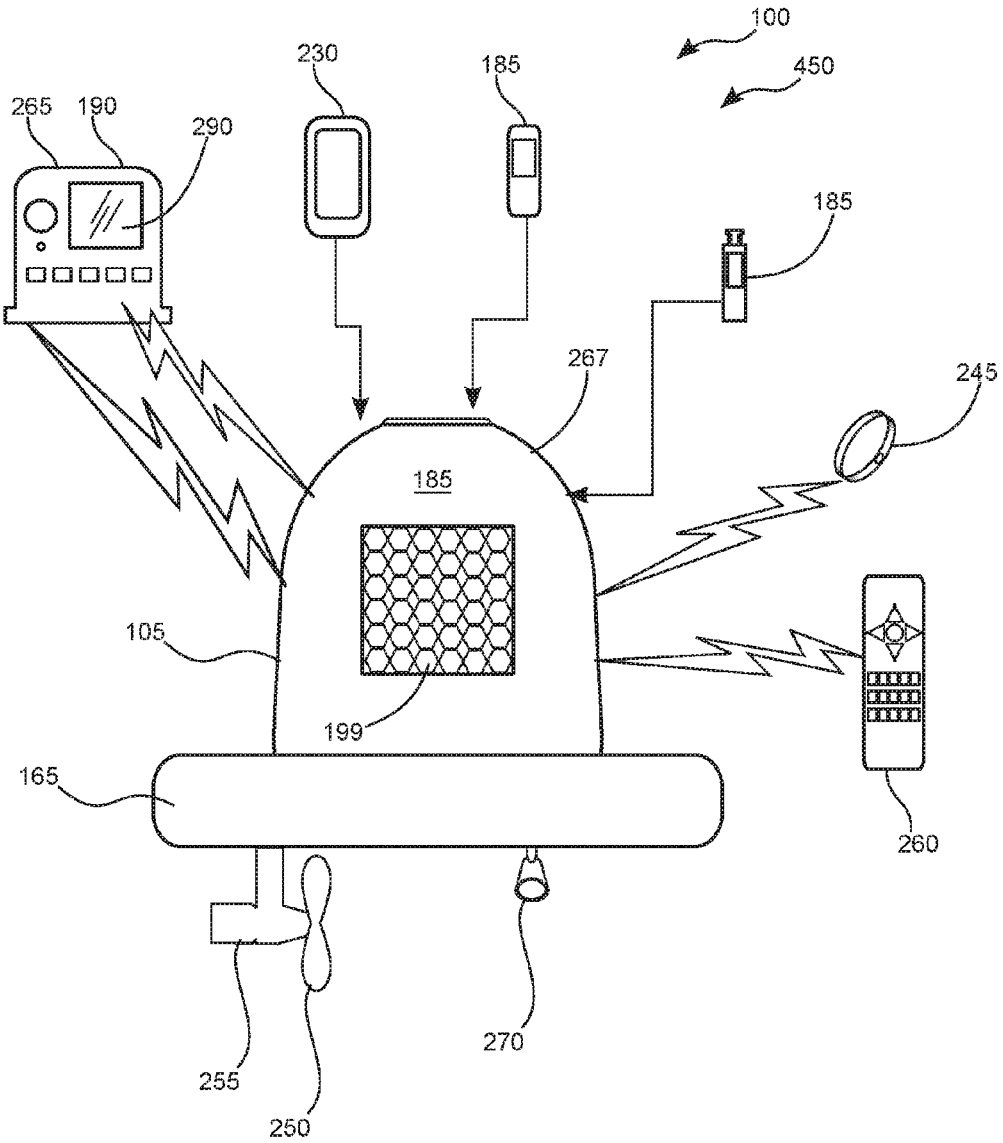
FIG. 5 is a diagram illustrating accessories for the floating entertainment and communication system according to an embodiment of the present invention of FIGS. 1-4.

Referring now to FIG. 5, showing a diagram illustrating accessories for floating entertainment and communication system 100 according to an embodiment of the present invention of FIGS. 1-4.

Floating entertainment and communication system 100 further may include a long life, deep cycle, rechargeable battery(s) 210.

Rechargeable battery(s) 210 is in communication with solar panel(s) 199 and able to receive a power recharge when solar rays are present. Waterproof docking station(s) 150 and the electronic device charging station(s) 160 are adapted to seal and protect digital electronic devices 155 that may be docked therein. In addition to the above mentioned accessories, floating entertainment and communication system 100 may further include an exteriorly located red light 235 capable of flashing when a signal from remote transmitter/receiver 190 in a paired sensor wristband 245 is received. Sensor wristband 245 is adapted to transmit a wireless signal to base transreceiver 267 in floating base 165 when a low oxygen level of the wearer is detected. Floating entertainment and communication system 100 may also include an audio response that may be transmitted to remote transreceiver 265 to warn of a possible emergency such as when sensor wristband 245 wearer is not breathing or receiving enough air as occurs during drowning. The system serves as an early warning system to prevent deaths from drowning.

In some embodiments, floating base 165 may include waterproof camera 270 adapted for use underwater that is mounted to bottom side 170 of floating base 165. The video signal from waterproof camera 270 is able to be transmitted to a remote viewing device 290, which may be the same remote transreceiver 265 for 2-way radio 275. A user remotely viewing the video transmissions may be able to monitor the safety of children or adults that are in the water. Rechargeable battery(s) 210 is sized to power propulsion system 250 as well as waterproof camera 270 and any other onboard accessories.

Floating entertainment and communication system 100 may be sold as kit 450 comprising the following parts: at least one floating entertainment and communication system 100 having an assembled upper portion 105 and floating base 165; at least one remote control unit 260; at least one audio/video player 185; at least one 2-way radio 275 system having a remote transreceiver 265 and base transreceiver 267; at least one waterproof camera 270 system for mounting to bottom side 170 of floating base 165; at least one rechargeable battery(s) 210; and at least one set of user instructions. The kit has instructions such that functional relationships are detailed in relation to the structure of the invention (such that the invention can be used, maintained, or the like in a preferred manner). Floating entertainment and communication system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A floating entertainment and communication system comprising:

an upper portion including a center structure having a first side and a second side, a left cover and a right cover hingedly attached at a top edge to said first side and said second side respectively of said center structure, a liquid crystal display screen and at least one speaker mounted in said first side of said center structure, at least one waterproof docking station adapted for use with a plurality of digital electronic devices, wherein said at least one waterproof docking station is adapted to be in communication with said liquid crystal display screen and said at least one speaker, and at least one electronic device charging station;

a floating base including a bottom side, a top side, and a base perimeter, wherein said upper portion is nonremovably attached to said top side of said floating base and wherein said floating base is adapted to float on a body of water while supporting said upper portion above a water level;

wherein said floating entertainment and communication system is useful for floating on a body of water and docking an electronic audio/video device within said at least one waterproof docking station and playing an amplified audio sound through said at least one speaker and a video signal through said liquid crystal display screen for entertainment while a user is swimming, and wherein said floating entertainment and communication system is useful for 2-way wireless communications between said floating base and a remote transmitter/receiver.

2. The floating entertainment and communication system of claim 1 wherein said left cover and said right cover each include a solar panel for powering said liquid crystal display screen, said speakers, and said electronic device charging stations.

3. The floating entertainment and communication system of claim 2 wherein said left cover and said right cover are designed to provide a watertight seal about said center structure when each are in a closed position.

4. The floating entertainment and communication system of claim 3 wherein said left cover and said right cover each include a means to be locked in an upwardly rotated position when in an in-use condition.

5. The floating entertainment and communication system of claim 4 wherein said left cover and said right cover each have a concaved formation designed to envelope and seal said center structure from moisture.

6. The floating entertainment and communication system of claim 1 wherein said floating entertainment and communication system further comprises a rechargeable battery.

7. The floating entertainment and communication system of claim 6 wherein said rechargeable battery is in communication with said solar panels and able to receive a power recharge therefrom.

8. The floating entertainment and communication system of claim 1 wherein said center structure and said floating base are adapted to be water resistant.

9. The floating entertainment and communication system of claim 1 wherein said floating entertainment and communication system is substantially constructed of buoyant foam having a hardened plastic shell.

10. The floating entertainment and communication system of claim 1 wherein said center structure having said left cover and said right cover in a closed position measures approximately 10 inches in height, approximately 10 inches in width, and approximately 3 inches in thickness.

11. The floating entertainment and communication system of claim 1 wherein said at least one waterproof docking station and said at least one electronic device charging station is adapted seal and protect a digital electronic device docked therein.

12. The floating entertainment and communication system of claim 1 wherein said floating entertainment and communication system further is adapted to include wireless 2-way radio communication.

13. The floating entertainment and communication system of claim 12 wherein said floating entertainment and communication system further includes a receptacle that is adapted to receiver a cellular phone.

14. The floating entertainment and communication system of claim 13 wherein said floating entertainment and communication system further includes an exteriorly located red light that is in communication with a wireless receiver, and wherein said red light is adapted to flash when a wireless signal is received from a paired sensor wristband.

15. The floating entertainment and communication system of claim 14 wherein said sensor wristband is adapted to transmit a wireless signal to said wireless receiver via a detection of a body low oxygen level of a wearer.

16. The floating entertainment and communication system of claim 1 wherein said floating base is adapted to include a wirelessly controlled propulsion system and steering system that is controlled via a remote control unit.

17. The floating entertainment and communication system of claim 16 wherein said remote control unit is adapted to manipulate the functions of a docked audio/video player and a volume of said at least one speaker of said center structure.

18. The floating entertainment and communication system of claim 1 wherein said floating base further includes a waterproof camera mounted to said bottom side and is adapted for use underwater, and wherein a video signal of said waterproof camera is adapted to be transmitted to a remote viewing device.

19. The combination of a floating entertainment and communication system, a remote control unit, an audio/video player, a 2-way radio, and an underwater camera system comprising:

(a.) an upper portion including a center structure having a first side and a second side, a left cover and a right cover hingedly attached at a top edge to said first side and said second side respectively of said center structure, a liquid crystal display screen and at least one speaker mounted in said first side of said center structure, at least one waterproof docking station adapted for use with a plurality of digital electronic devices, wherein said at least one docking station is adapted to be in communication with said liquid crystal display screen and said at least one speaker, and at least one waterproof electronic device charging station;

a floating base including a bottom side, a top side, and a base perimeter, wherein said upper portion is nonremovably attached to said top side of said floating base and wherein said floating base is adapted to float on a body of water while supporting said upper portion above a water level;

wherein said floating entertainment and communication system is useful for floating on a body of water and docking an electronic audio/video device within said at least one docking station and playing an amplified audio sound through said at least one speaker and a video signal through said liquid crystal display screen for entertainment while a user is swimming;

(b.) an underwater camera system adapted to be used with said floating entertainment and communication system;

(c.) an audio/video player adapted to be used with said floating entertainment and communication system;

(d.) a 2-way radio adapted to be used with said floating entertainment and communication system comprising:

a transmitter and a receiver located on said floating entertainment and communication system;

(e.) a remote transmitter/receiver adapted for use with said floating entertainment and communication system; and (f.) a propulsion and steering control system adapted to provide a remote navigation means for said floating entertainment and communication system; and (g.) a remote control unit adapted for use in controlling said audio/video player, a volume of said at least one speaker, and said propulsion and steering control system.

20. The floating entertainment and communication system of claim 19 further comprising a kit including:

a floating entertainment and communication system having an upper portion and a floating base;

at least one remote control unit;

at least one audio/video player;

at least one 2-way radio system having a remote transmitter/receiver and a base transmitter/receiver;

at least one underwater camera system for mounting to said bottom side of said floating base;

at least one rechargeable battery; and at least one set of user instructions.

* * * * *